US005471790A

United States Patent [19]

Payne

[11] Patent Number: 5,471,790

[45] Date of Patent: Dec. 5, 1995

[54] ELECTRICAL SWING GATE

[76] Inventor: Guy M. Payne, 431 Main, Stinett, Tex. 79007

[21] Appl. No.: 224,888

[22] Filed: Apr. 8, 1994

[51] Int. Cl.[6] ..... E05D 7/06

[52] U.S. Cl. ..... 49/236; 49/307

[58] Field of Search ..... 49/208, 236, 366, 49/367

[56] References Cited

U.S. PATENT DOCUMENTS 664,078 12/1900 Frank et al. ..... 49/236 X 3,264,786 8/1966 Nettles ..... 49/236 X 4,145,842 3/1979 Clugston ..... 49/236 X

*Primary Examiner*—Peter M. Cuomo

*Assistant Examiner*—Jerry Redman

[57] ABSTRACT

A pair of swingable electrified gate sections in a closed position, to be swung to an open position by the travel of a center pivot irrigation system. As the center pivot system travels through the gate area, the gate closes. Each section is connected to an electric fence wire that is attached to a clamp at the distile end of the gate section. The gate sections also allow the center pivot irrigation system to travel through the fenced areas with only slight interruption of fence security.

1 Claim, 2 Drawing Sheets

ELECTRICAL SWING GATE

BACKGROUND AND BRIEF DESCRIPTION OF THE INVENTION

This invention generally deals with gate structures and pertains more particulary to an electric swing gate which is opened by a center pivot field irrigation system approaching the gate areas and is closed after the center pivot system has passed through.

Currently there is no way for a center pivot irrigation system to maneuver through an electrical fenced field without wire entanglement and energy interruption.

Others in the past have suggested the employment of mechanisms which might be proven faulty and troublesome, for one or more reasons. A primary reason for lack of success of other mechanisms is subject to wire entanglement and energy interruption.

The present invention overcomes the deficiencies in the previous designs and provides a center pivot irrigation system to manuver through an electric fenced field.

A primary object of the present invention is to provide an electrical swing gate which allows a center pivot field irrigation system to maneuver through an electrically charged fence. Other and further objects of the invention will be made clear or will become apparent in the course of the following description of a preferred embodiment of the invention.

DETAILED DESCRIPTION OF THE INVENTION

In the accompanying drawing.

Figure 1:
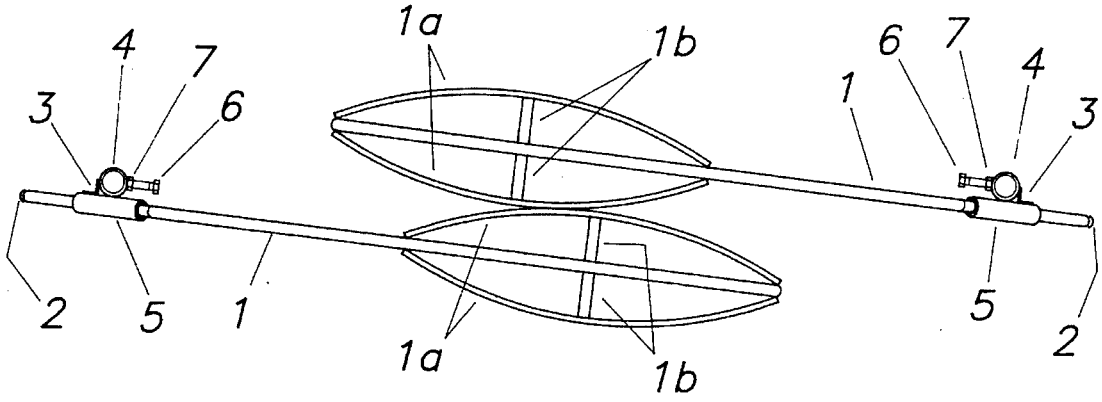
FIG. 1 is the top plan view of the electrical swing gate, mounted in a closed position prior too engagement of the center pivot irrigation system.
Figure 2:
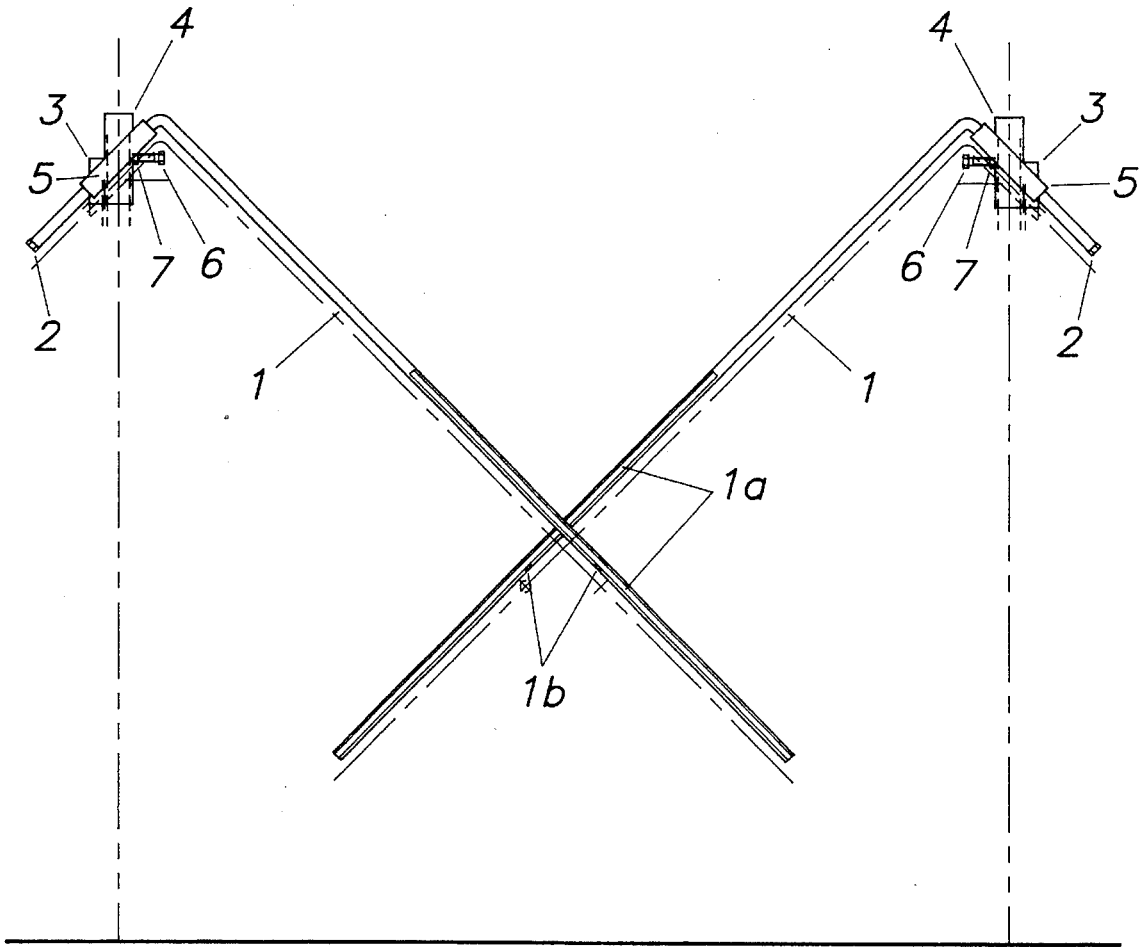
FIG. 2 is a side elevational view of the electrical swing gate which forms the preferred embodiment of the present invention just prior to engagement therewith.
Figure 3:
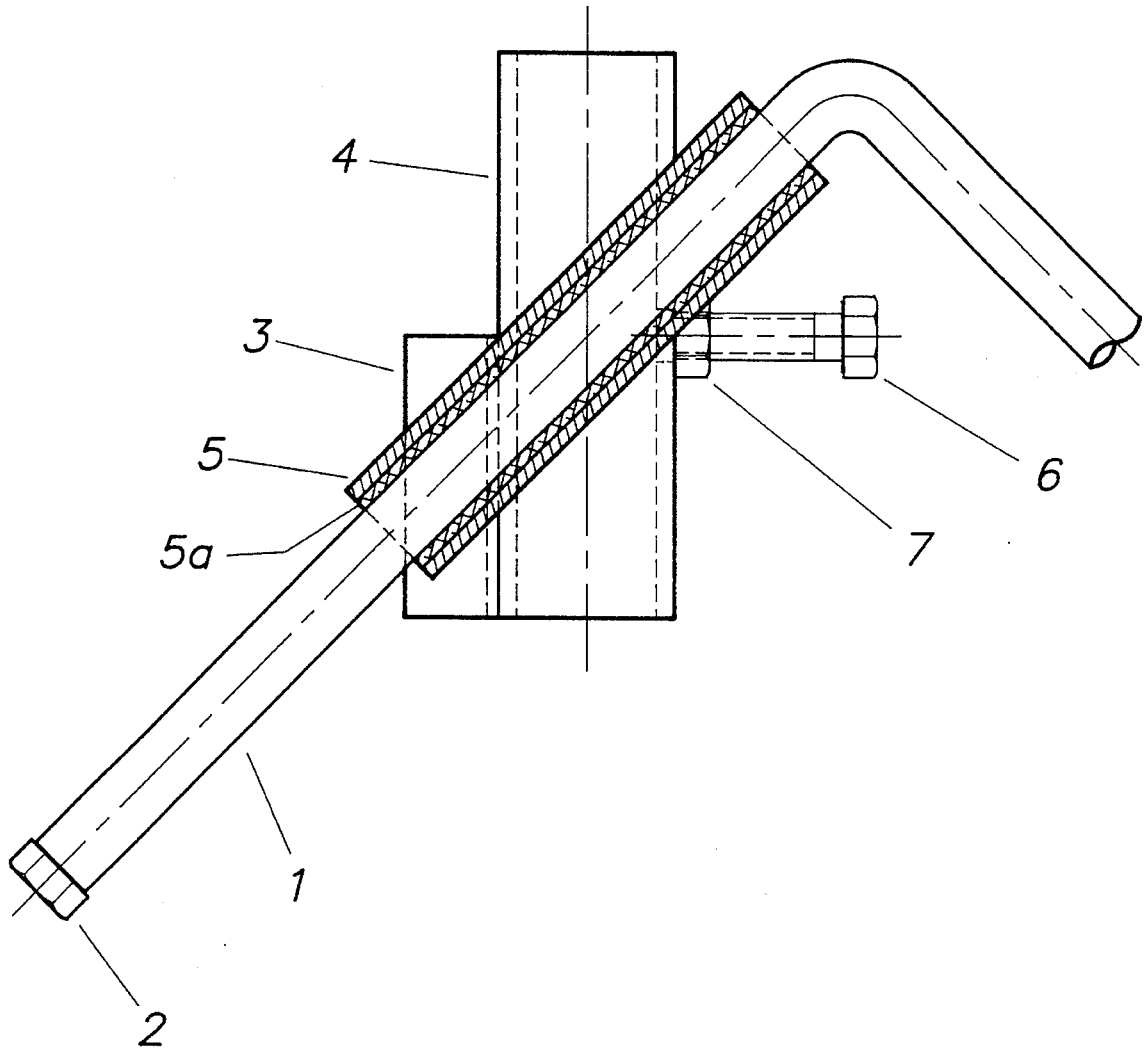
FIG. 3 is a fragmentary side cross sectional view of a T-post fence unit.

Referring now to the drawings, the entire unit fits over a standard T-post. The unit itself consists of a ¾ inch O.D. rod or pipe bent into a 1 foot short section and 5 feet section in a L shape #1. The lower 3 feet of the 5 foot section is expanded parabolically to 6¾ inch #1*a*, by small braces #1*b*. The short section has on it, near the curve, a piece of 1 ½ inch I.D. pipe 6 inches long #4, with a ½ inch by 2 inch bolt welded #6 to the center, (bolt passes through a ½ inch nut #7) A 1 inch by 1 inch angle iron, 3 inches, long is welded to the base of the 1½ inch tubing #4. A 1 inch section of tubing, 6 inches long, #5 is welded at a 45 degree angle to the 1 inch by 1 inch angle iron #3 and 1½ inch tubing #4. This 1 inch by 6 inch tubing #5 as a non-conductive insert #5*a*. The electric fence wire is attached to a clamp at the distile end of the 5 foot section #2. The total unit can be pipe, conduit rod. The material of construction can be metal, plastic, wood or any other malleable, weldable, or glueable materials.

I claim:

1. An electrical swing gate assembly comprising a first section attached to a post and a second section attached to a post;

said first and second sections having a first end and a second end and a bent portion between said first and second ends;

an electrical fence wire attached to each of said first ends and an expanded section forming each of said second ends wherein each of said expanded sections overlap in a closed position;

said first and second sections allows passage of an object with only a slight interruption of fence security.

* * * * *